US006810209B2

(12) United States Patent
Prigent

(10) Patent No.: US 6,810,209 B2
(45) Date of Patent: Oct. 26, 2004

(54) METHOD TO ESTABLISH SENSITOMETRY CURVE FOR A PHOTOGRAPHIC MEDIUM

(75) Inventor: Thierry Prigent, Saint-Helene (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/690,135

(22) Filed: Oct. 21, 2003

(65) Prior Publication Data

US 2004/0086272 A1 May 6, 2004

(30) Foreign Application Priority Data

Oct. 24, 2002 (FR) ..... 02 13266

(51) Int. Cl.[7] ..... G03C 5/02

(52) U.S. Cl. ..... 396/563; 355/77; 356/404; 430/30; 430/359

(58) Field of Search ..... 396/563; 355/77; 356/404; 430/30, 359

(56) References Cited

U.S. PATENT DOCUMENTS

| | | | | | |
|---|---|---|---|---|---|
| 3,718,074 | A | * | 2/1973 | Davis | 396/315 |
| 4,464,015 | A | * | 8/1984 | Shafer | 359/472 |
| 4,687,334 | A | * | 8/1987 | Miyakawa | 356/404 |
| 5,481,480 | A | * | 1/1996 | Green et al. | 700/293 |
| 5,563,717 | A | | 10/1996 | Koeng et al. | 358/406 |
| 5,667,944 | A | | 9/1997 | Reem et al. | 430/359 |
| 6,154,272 | A | * | 11/2000 | Vanderbrook | 355/77 |
| 6,284,445 | B1 | | 9/2001 | Keech et al. | 430/495.1 |

* cited by examiner

*Primary Examiner*—W. B. Perkey
(74) *Attorney, Agent, or Firm*—Thomas H. Close

(57) ABSTRACT

The invention relates to a method to establish a sensitometry curve for a photographic medium, including the following steps: the formation on the medium of at least one sensitometry control by exposing many ranges of the medium with various exposure energies; the capture of the optical density values of the sensitometry control in each range; the formation from the captured values of sensitometry curve sections; and the energy offset of the curve section to obtain a partial overlap of sections corresponding to neighboring exposure energies.

21 Claims, 5 Drawing Sheets

METHOD TO ESTABLISH SENSITOMETRY CURVE FOR A PHOTOGRAPHIC MEDIUM

FIELD OF THE INVENTION

The present invention relates to a method to establish a sensitometry curve for a photographic medium such as film. A sensitometry curve means a curve, a characteristic table, or a set of density values and exposure energies, which enable a medium exposure value to be linked to its optical density. The sensitometry curve is still called the Hurter-Driffield curve. Optical media, especially films, generally have a known sensitometry response. The film's response is an important datum for adjusting a number of cameras or devices taking the film. Among these, for example one can mention still cameras, development equipment, and film digitizing systems. The exact adjustment of these devices, according to the film's response, enables the restoration, at the output of a processing chain, of images reproducing, as faithfully as possible, the scenes taken.

The sensitometry response of a photographic medium is sensitive to parameters like the manufacturing processes, the conditions, and storage duration of the medium. It can also vary in time and its prior knowledge can turn out to be inaccurate at the time the medium is processed. This difficulty can be overcome by establishing for each photographic medium a specific sensitometry curve that allows for its aging. The aging is allowed for both before and after development.

The invention has applications for all types of photographic media and, especially, photographic papers and films. While not being reserved solely for the field of the professional image, the invention mainly aims to establish sensitometry curves for films used in motion picture cameras.

BACKGROUND OF THE INVENTION

To establish the sensitometry curve of a photographic medium, a sensitometry control is formed on a reserved part of the medium. Sensitometry controls generally comprise one or more ranges that are exposed with various exposure energies. These energies are known and carefully calibrated. Sensitometry controls comprise, for example, 21 ranges, subject respectively to various energy exposures, but uniform for each range.

In a motion picture camera, a series of 21 consecutive views can be exposed, taken in a leader part of a film, with increasing calibrated energies.

The sensitometry curve can easily be established by measuring the optical density in each range of the sensitometry control and by associating to these measurements the values of the exposure energies. The establishment of the sensitometry curve can be limited to the simple collection of the measurements, associated with their exposure values, or possibly be represented in graph form. The representation is generally produced as a logarithmic scale.

The accuracy of the sensitometry curve depends on the quality of the density measurements and the accuracy of the exposure of the various ranges of the sensitometry controls. In so far as the equipment used to form the controls and their reading is perfectly calibrated, the establishment of the sensitometry curve is not especially difficult.

Devices for forming the sensitometry controls with perfectly known exposure energies are however costly. Moreover, when many different cameras are liable to be used to produce the shots, it is necessary to make uniform the sensitometry controls produced by the exposure equipment of the various cameras. Thus the cameras must be provided with calibrated standardized exposure means.

These difficulties are obstacles to establishing and automatically allowing for a film's sensitometry response.

SUMMARY OF THE INVENTION

The goal of the invention is to propose a method for establishing the sensitometry curve of a medium that enables the difficulties mentioned above to be obviated.

One goal in particular is to propose such a method that does not require an accurately calibrated exposure means for forming sensitometry controls.

One goal is also to propose a method enabling a reliable sensitometry curve to be obtained despite having especially rudimentary equipment on board the camera.

One goal is finally to propose such a method that enables the area of the sensitometry control to be limited to a smaller area of the photographic medium.

To achieve these goals the object of the invention is more precisely a method for establishing the sensitometry curve for a photographic medium, the method comprising: the formation on the medium of at least one sensitometry control by exposing many ranges of the medium with various exposure energies, the exposure energy of each range being modulated according to a spatial modulation profile (P(x)) identical for all the ranges; the capture of optical density values of the sensitometry control in each range and in regions corresponding to various values of the modulation profile; the formation of sensitometry curve sections, each section being formed from density values captured in various ranges of the sensitometry controls, but in regions corresponding to the same value of the modulation profile of the exposure energies; and the energy offset of the curve sections to obtain partial section overlapping corresponding to neighboring exposure energies.

In the sense of the invention, the sensitometry curve is considered, independently from its graphic representation, as a means enabling the optical densities to be linked to the exposure energies of a medium. It may be summarized as a table or a simple collection of numerical values linking the optical density of the medium to the exposure energy received by the latter.

At the time of the exposure of the sensitometry control, the value of the exposure energy supplied in each range is not known with any great accuracy. The uncertainty about the exposure energies originates essentially from the uniformity defects of the exposure light sources liable to equip the cameras, and in the inaccuracy of their calibration. When the exposure means are rudimentary, the uncertainty about the exposure energies can be significant.

In a preferred implementation of the invention method, the exposure energies of the various ranges can follow a regular or not determined progression. In addition, the progression can take place with reference to a known or not energy value. While the regularity or exact knowledge of the progression of the energies is an advantage, it is not essential. This aspect will be re-examined in the description that follows. The progression of the exposure energies can be increasing or decreasing.

The lack of sure information as to the real value of the exposure energies received by the photographic medium is somewhat compensated for by the sure information according to which the modulation profiles of the various ranges are identical. In this way, by energy offsetting the curve sections, according to the invention, one can combine the information coming from the various regions of the exposure ranges, for the various modulation values of the exposure energy. This combination enables a continuous sensitometry curve to be obtained.

It should be noted that after the energy offset of the curve sections, and obtaining a continuous sensitometry curve, this curve can again be assigned with a global energy error. This global error results from the absence of an absolute energy reference for at least one of the sections. The global energy error of the sensitometry curve is not however prejudicial to its use. In fact it does not affect the essential characteristics of the curve, such as its slope and inflexions.

The formation of sections under step c) may be done in graph form. However, it preferably comprises the association with each density value, of an exposure energy value estimated according to the range of the sensitometry control in which the density value is captured, and in addition, the formation of density value sets, each set containing respectively the optical density values captured in the various ranges of the sensitometry control but in regions corresponding to the same value (P) of the modulation profile. Thus, step d) of the method can comprise simply the uniform offset of all the energy values of the same set of data. The value sets here correspond with the curve sections.

More precisely, and according to one special implementation option of the steps c) and d) of the method, this can comprise respectively: the formation of density matrices whose columns, respectively rows, correspond with increasing density values, respectively decreasing, of the same set of values; the intercorrelation of the columns, respectively rows, in relation to at least one column, respectively row, taken as reference; the search for an energy offset, for each column, respectively row, corresponding to a minimum of an intercorrelation function of the columns, respectively rows; and the application of the energy offset to the estimated exposure energy values of the set of values of the matrix column, respectively row.

The intercorrelation function is, for example, a sum function that is performed on the rows of the matrix and that acts on the absolute value of a difference between the matrix elements belonging to one column corresponding to a section of the curve to be offset, and the matrix elements belonging to a column corresponding to a section of the curve selected as reference. Other conventional intercorrelation functions can be selected and in particular quadratic intercorrelation functions. Offsetting the sections means in relation to the section taken as reference, or in relation to an arbitrarily fixed reference.

The method as described above can be applied to monochrome photographic medium, black and white type, or to color photographic medium. In the first case, a single exposure source of the medium is sufficient. Each captured density value is then associated with a single exposure energy value delivered by this source.

In the second case, i.e. for color media, it is possible to determine one sensitometry curve for many sensitive layers of the medium. For example, one sensitometry layer is determined for each of the basic colors: red, green and blue. A source with three color components then supplies the exposure energy. The medium's optical density is associated with a linear combination of the exposure energies for each of the colors.

As an illustration, the density D (x, y) at a coordinate point (x, y) of a monochrome medium will have the following form:

$$D(x,y)=S(E*P(x,y)).$$

In this expression S denotes a function representative of the sensitometry response of the photographic medium. Knowledge of the function S is given by the sensitometry curve. The term E denotes the exposure energy supplied by the source and P(x, y) the value of the energy modulation profile at the point (x, y). The value of P(x, y) is, for example, a value between 0 and 1 when the means used to perform the modulation is an attenuator, such as a filter.

For a color medium subjected to three monochromatic sources supplying respectively energies $E_{red}$, $E_{green}$ and $E_{blue}$ the following expressions are obtained in the same way:

$$D_{red}(x,y)=S_{red}(C_{rr}*E_{red}*P_{red}(x,y)+C_{gr}*E_{green}*P_{green}(x,y)+C_{br}*E_{blue}*P_{blue}(x,y))$$

$$D_{green}(x,y)=S_{green}(C_{rg}*E_{red}*P_{red}(x,y)+C_{gg}*E_{green}*P_{green}(x,y)+C_{bg}*E_{blue}*P_{blue}(x,y))$$

$$D_{blue}(x,y)=S_{blue}(C_{rb}*E_{red}*P_{red}(x,y)+C_{gb}*E_{green}*P_{green}(x,y)+C_{bb}*E_{blue}*P_{blue}(x,y))$$

In the above expressions the same letters denote the same variables or functions as those previously mentioned and the indices "red", "green" and "blue" show that these values or functions are specific to these colors. The indices $C_{rr}$, $C_{gr}$, $C_{br}$, $C_{rg}$, $C_{gg}$, $C_{bg}$, $C_{bg}$, $C_{rb}$, $C_{bb}$ are the coefficients of the linear combinations.

Among these indices, indices $C_{rr}$, $C_{gg}$ and $C_{bb}$ are near 1 whereas the other indices are generally less than 1, because of the spectral selectivity of the sensitivity layers of the photographic medium.

As shown previously, the exposure energies of the various ranges are preferably selected to follow a regular progression, increasing or decreasing with known deviations. This may be obtained very simply by controlling, for example, the intensity of the electrical supply current of the exposure source or the duration of supplying the source for a given constant intensity. The adjustment of the exposure duration profits from the light integration capacities by the photographic medium. The regular progression of the exposure energies of the various ranges facilitates the relative positioning of the energy values to construct a sensitometry curve.

When the energies do not follow a regular progression, there is an additional uncertainty for the value of each energy. In this case, the method can be completed by one or more steps to correct the estimated exposure energy values. Such a step comprises, for example: the association with each density value, of an estimated exposure energy value according to the range of the sensitometry control in which the density value is captured and according to an estimated value of the modulation profile (P) in the region of the range in which the density value is captured; and the uniform offset of the energy values associated with at least one set of density values captured in the same range of the sensitometry control, so as to tend to a single sensitometry curve.

The value P of the modulation profile corresponding to each region, that is initially not known, can be directly calculated from the energy offset for which the curve section has been assigned. More precisely the energy offset taken on a logarithmic scale is simply equal to the value of the function P in the relevant region.

Other characteristics and advantages of the invention will appear in the following description, with reference to the figures in the appended drawings. This description is given purely as an illustration and is not limiting.

BRIEF DESCRIPTION OF THE DRAWINGS

FIG. 1 is a graph showing the power supply conditions of the first exposure means; part (c) shows, as graphs, the spatial distribution of the energy supplied by the first exposure means in the various power supply conditions. All of these elements illustrate one step of a particular implementation of a method according to the invention.

DETAILED DESCRIPTION OF THE INVENTION

In the following description, identical, similar or equivalent parts of the various figures are marked by the same reference signs. In order to be clear, various parts of the figures are not necessarily represented according to a uniform scale.

Figure 1:
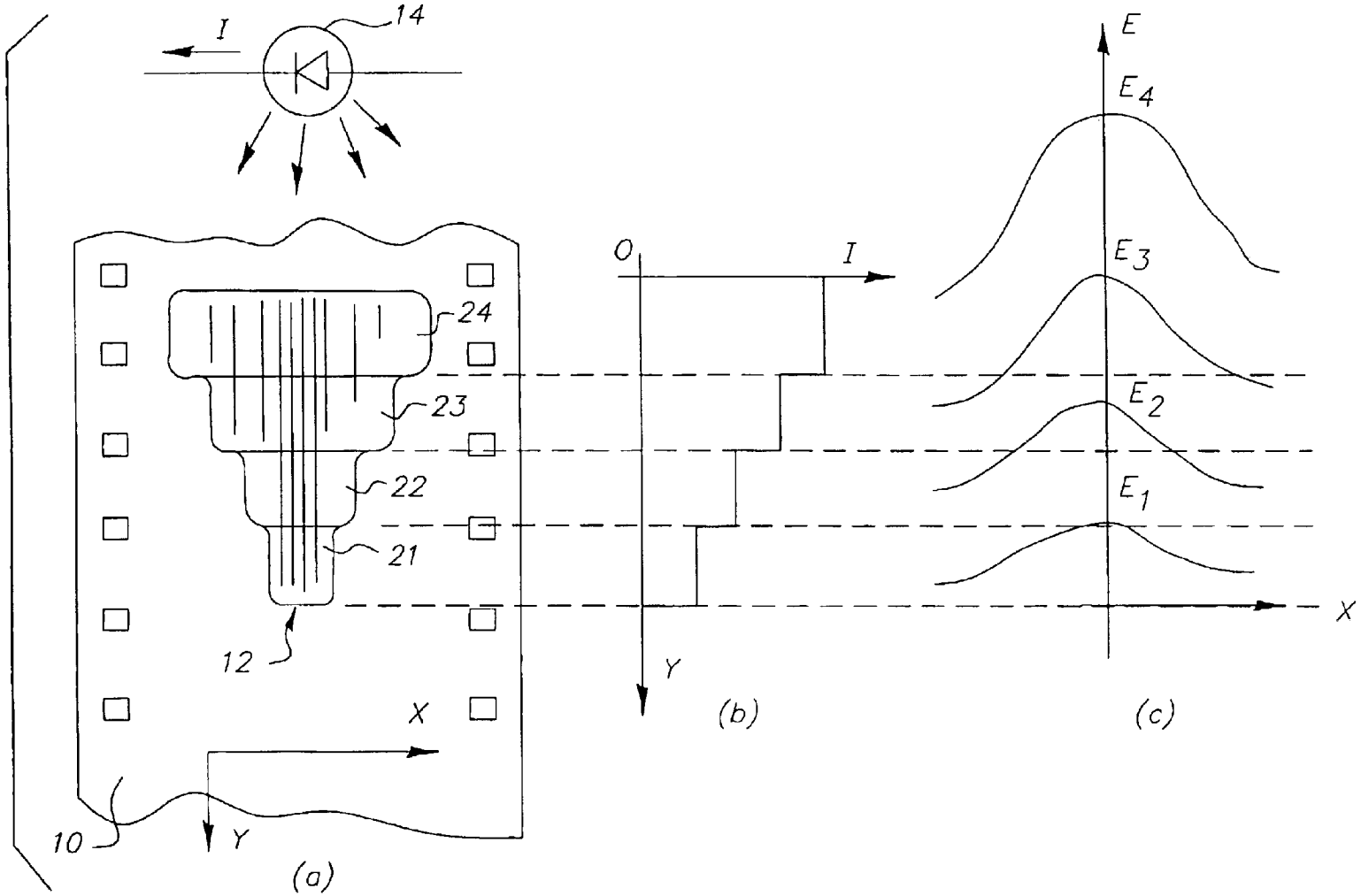
FIG. 1 shows, in a schematic and simplified way: part (a), a film having a sensitometry control and a first exposure means used to form the control; part (b)

In part (a) of FIG. 1, reference 10 denotes a photographic film, that for simplification purposes is considered as being a black and white film. Before filming a scene through a camera lens, a small part of the film is used to form a sensitometry control 12. The control 12 is formed in a part of the film, for example a leader part, that is then kept from the light.

The sensitometry control is formed by subjecting the film to a light source 14 used as an exposure means. In the case of a color film the single source 14 can be simply replaced by several sources having different spectral emission ranges. In the example illustrated, the light source has a simple light emitting diode (LED). Such a component is not very costly or bulky. Further, and this is an especially useful aspect, the diode supplies light with non-uniform spatial distribution, but having a form more or less invariable with the delivered light energy. In other words the energy is modulated according to a profile more or less independent of the emitted energy. While not being represented on the figure for simplification purposes, the light source can be associated with optical parts, such as, for example a lens or filter. These parts contribute, as required, to fixing a modulation profile of the emitted light and directing the light emitted towards the film.

In the example of FIG. 1, the sensitometry control is produced while making the film 10 run in front of the light source in a direction Y shown by an arrow. This enables the area occupied by the control 12 to be reduced to a minimum on the surface of the film. During the running of the film the intensity I of the current supplying the source 14 is not maintained constant but is modified in successive steps. This appears on the part (b) of the figure that represents, as a graph, the intensity I of the current applied to the source 14. The intensity is expressed as a function of time, which related to the continuous movement of the film, corresponds to a position y taken according to the running direction Y. The matching lines between the parts (a) and (b) of the figure show that to each intensity of power supply current there corresponds a range 21, 22, 23, 24 of the sensitometry controls. The number of ranges is limited to four to make the figure clear. The number of ranges is however preferably between 3 and 10. In the example illustrated the increments of the power supply current have constant and determined value. The current that, in the illustrated example, is modified by discrete increments can also be modified continuously or quasi continuously.

Part (c) of FIG. 1 shows the spatial distribution of the light energy in each of the ranges 21, 22, 23, 24 of part (a). For simplification, we only consider a spatial distribution of the energy according to an axis X perpendicular to the direction Y of the film running. The axis X is shown by an arrow. In this way, the energy distribution according to the direction Y is considered as more or less constant in each range or at least in a central zone of each range. As mentioned above, the energy is modulated according to a spatial modulation profile according to this axis. Preferably, the amplitude of the spatial modulation is selected to be more than the difference between the successive exposure energies of the ranges. In other words the modulation profile has an amplitude more than a minimum exposure difference between the ranges of the exposure controls. Preferably, the profile amplitude is selected to be more than double the minimum exposure difference between two ranges of the exposure controls.

To each intensity I of the power supply current of the light source there corresponds a range 21, 22, 23, 24 of the sensitometry control and a delivered light energy.

The energy $E_1(x)$ received in one region of coordinate x according to the axis X, in the range 21 has the form $E_1(x)=E_1*P(x)$ where P(x) is the value at point x of the modulation profile. In a logarithmic space, usual for the expression of the photographic exposure energies, this gives $\text{Log } E_1(x)=\text{Log } E_1+\text{Log } P(x)$. In the ranges 22, 23 and 24 we may also write:

$$\text{Log } E_2(x)=\text{Log } E_2+\text{Log } P(x),\ \text{Log } E_3(x)=\text{Log } E_3+\text{Log } P(x),\ \text{and}\ \text{Log } E_4(x)=\text{Log } E_4+\text{Log } P(x).$$

Figure 2:
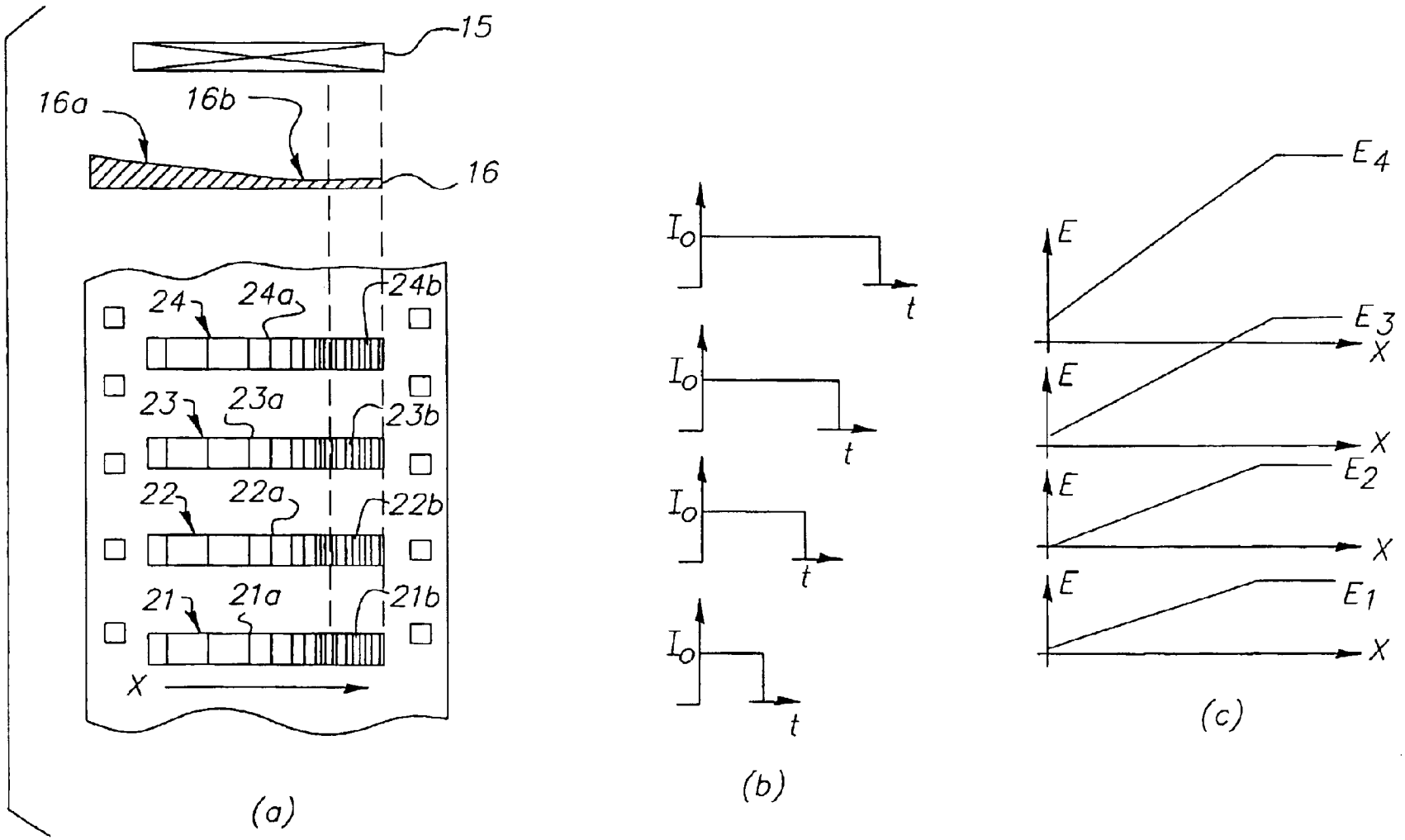
FIG. 2 shows the elements identical to those of FIG. 1 and illustrates one step of implementation of a variant of the method, also according to the invention.

FIG. 2 shows in part (a), the formation of a sensitometry control 12 with the ranges 21, 22, 23, 24 with form different than that of the ranges of the control of FIG. 1. The ranges 21, 22, 23, 24 are no longer formed by making the film run but are formed successively, when the film is stopped between the running periods. Further, the light source 14 of FIG. 1 is replaced by a light source 15 with a more or less uniform spatial distribution. A filter 16 is arranged between the source 15 and the film 10. The purpose of the filter 16 is to modulate the exposure energy according to a position x measured according to the axis X. It can be seen that one part 16*a* of the filter has one thickness, and thus a gradually varying transparency, and that another part 16*b* has a constant thickness. The modulation of the energy only occurs in the first part 16*a* of the filter.

Like for the formation of the sensitometry control of FIG. 1, the various ranges 21, 22, 23, 24 of the sensitometry controls of FIG. 2 are exposed with various exposure energies. The exposure variations are obtained, no longer by varying the intensity of the power supply current of the source 15, but the application time of this current. The current is maintained at a constant value $I_0$. Graphs of part (b) of FIG. 2 show at an arbitrary scale the currents supplied to source 15 to form each range of the sensitometry control. Controlling the exposure energy by the exposure time is facilitated by the fact that the exposures occur when the film is immobile.

The graphs of part (c) of FIG. 2 show, on a free scale, the light energy received by the film according to the position x, measured according to the axis X. By considering that part 16*b* of the filter is more or less transparent, the energy received in parts 21*b*, 22*b*, 23*b*, 24*b*, of the film correspond to the maximum energies $E_1$, $E_2$, $E_3$, $E_4$ delivered by the source when forming each range. However, in parts 21*a*, 22*a*, 23*a* and 24*a* of the ranges the energy is modulated according to a profile that is here more or less linear. Parts 21*b*, 22*b*, 23*b*, 24*b*, of the sensitometry control can possibly be used to capture reference values, when one or more exposure energies are known. However this is an accessory aspect in so far as one of the main goals of the invention is to establish a sensitometry curve even in the absence of a calibrated exposure source. Indeed, it is sufficient that the energy emitted by the sources is compatible with the film's sensitivity range, or even only one part of this range.

Figure 3:
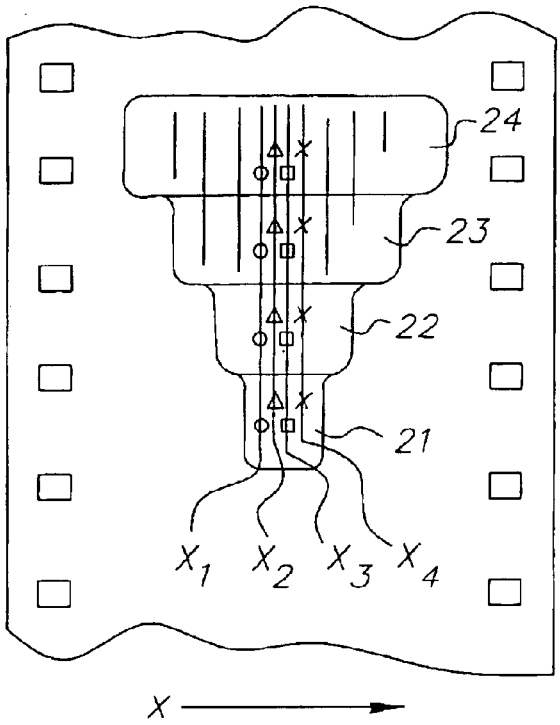
FIG. 3 is a representation of a sensitometry control conform to part (a) of FIG. 1 and illustrates one option of capturing the density values.

FIG. 3 is a representation, somewhat expanded, of the film of part (a) of FIG. 1 and illustrates one step of capturing the density values. The density values are captured in each range 21, 22, 23, 24 of the sensitometry controls. The capture can occur in a known way with equipment such as digital scanners. These provide digital data related to the density value.

Density value sets are captured in each range. In addition it can be stated that the values are captured in various regions of each range corresponding to various values of the modulation profile. In the illustrated example, all the densities captured in the regions with the same coordinate x according to the axis X correspond with the same value of the modulation profile, and independently of the relevant range. In each region, as many different density values as the control has exposure ranges can be captured.

For illustration, density values captured at coordinate points $x_1$, $x_2$, $x_3$, $x_4$ are shown by small circles, triangles, squares and stars. In each region, i.e. for each coordinate according to the axis X, at least one density value is captured in each range of the sensitometry controls. The density value captured in a given region of a given range of the sensitometry control can result from a single measurement. Preferably, however, the selected value is an average value made on the entire region, or at least its central zone, in the relevant range. The fact of only selecting a central zone of the region copes with any edge effects that might affect the uniformity of the exposure.

Capturing values or any exposure intensities could also be modulated to allow for non-uniformity of the speed of film advance in the camera.

Figure 4A:
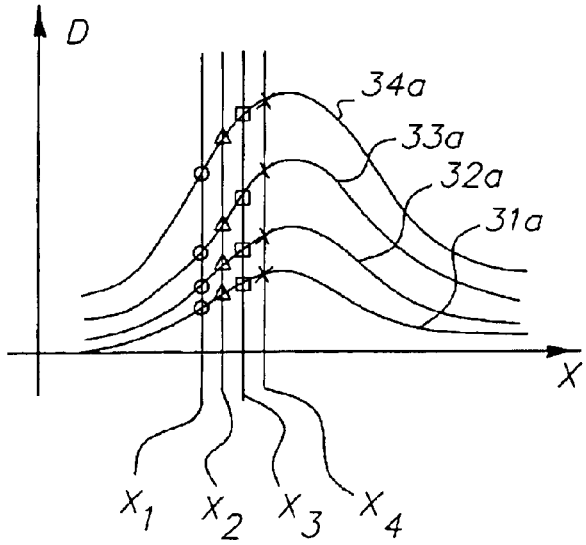
FIG. 4 is a graph showing a spatial distribution of the optical densities of the sensitometry control of FIG. 3.

FIG. 4A is a graph expressing the captured densities for the sensitometry control of FIG. 3. The densities and the coordinates x of the regions according to the axis X are expressed in free scale. The graph has four curves 31*a*, 32*a*, 33*a*, 34*a* corresponding to the four ranges 21, 22, 23, 24 of FIG. 3 and to the successive exposure energies $E_1$, $E_2$, $E_3$, $E_4$. To facilitate the link with FIG. 3, points corresponding to the captured density values are shown on FIG. 4A with the same geometric shapes. The graphic representation of FIG. 4A corresponds to the data sets associating the density values with the energy values respectively.

Figure 4B:
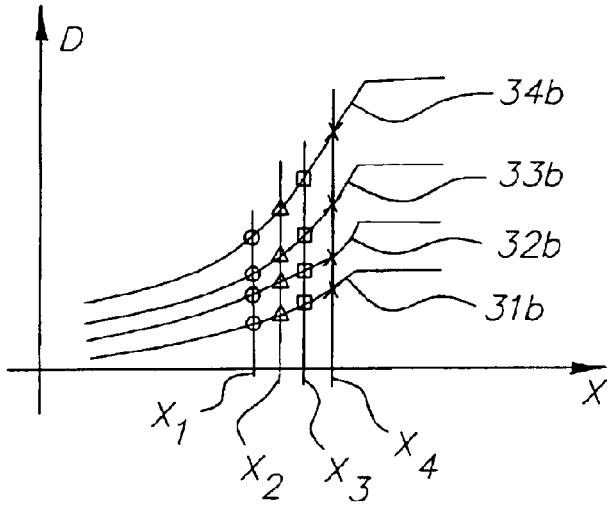

FIG. 4B does not call for special comment except that it is constructed from the density values captured on the ranges of a sensitometry control conform to that of part (a) of FIG. 2. The previous description may be referred to. It can be seen that the curves of FIG. 4B are not linear despite the more or less linear character of the filter 16 of FIG. 2. This simply conveys the non-linear character of the photographic medium. The curves 31*b*, 32*b*, 33*b*, 34*b* are those recorded in the ranges 21, 22, 23, 24 of the sensitometry control of FIG. 2. They correspond to the energies $E_1$, $E_2$, $E_3$ and $E_4$ respectively.

Figure 5:
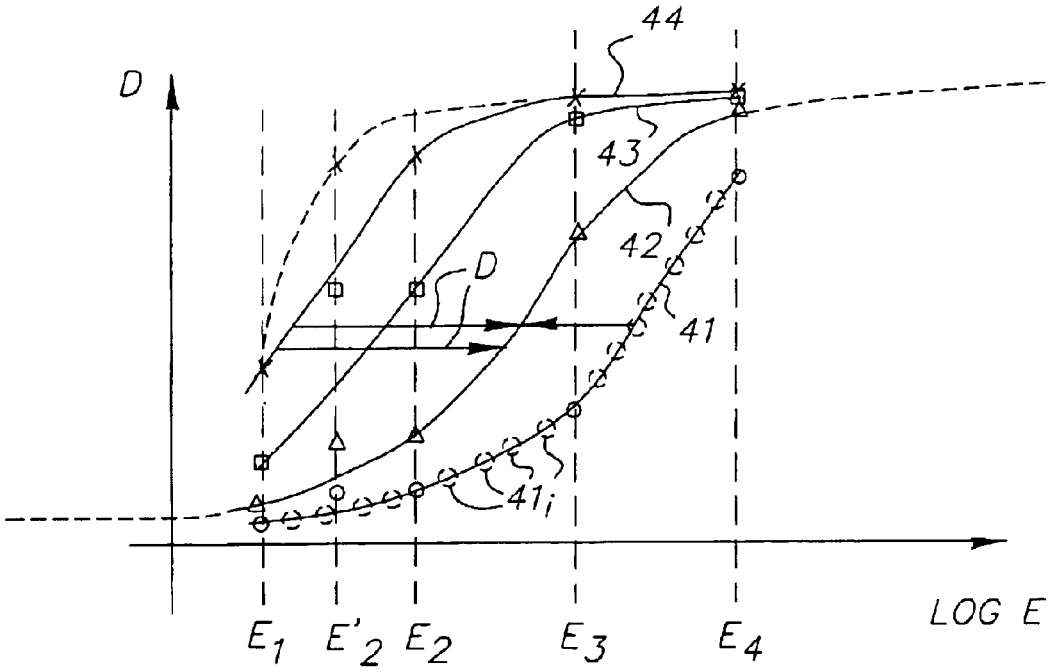
FIG. 5 represents sections of the sensitometry curve linking the density values to the energy values.

FIG. 5 is a graph constructed from the data of the graph of FIG. 4A. It expresses, in free and logarithmic scales, the optical density values of the film according to the estimated exposure energies $E_1$, $E_2$, $E_3$ and $E_4$. To simplify the description, we initially take the estimated energies and the actual exposure energies $E_1$, $E_2$, $E_3$ and $E_4$ to be identical. Then we examine the situation in which an estimated energy value is wrong. FIG. 5 shows sections of sensitometry curves formed with the density values captured in the regions corresponding to the same value of the modulation profile. Each section corresponds to one part of the sensitometry curve that we are trying to obtain. The graph is only an illustration of an operation consisting in forming data sets associating respectively the exposure energy values of the various ranges with the density values captured in the regions corresponding respectively to the same value of the modulation profile of the exposure energies.

To be clear, the figure only shows four curve sections that correspond with the regions whose coordinates on the axis X of the FIG. 1 are $x_1$, $x_2$, $x_3$, $x_4$. However, this is not to predict the number of value sets liable to be formed and that can be some hundreds. The number of value sets stays linked to the resolution of the scanner used to capture them.

The value sets can be formed from the captured values or can be completed by interpolation values. This is illustrated on the curve section 41 where intermediate interpolation values are shown symbolically with a broken line. The interpolation can simply be linear. It can also be more sophisticated. For example, the interpolation can be performed by allowing for the general shape of a Hurter-Driffield type curve. This can be done by fixing all along the interpolation curve, limits to the derived values of the interpolation curve.

As FIG. 5 shows, there is no continuity between the various sections. Very precisely, the curves are offset in energy by an amount that depends on the logarithm of the function representative of the modulation profile. As an illustration, and by taking the curve sections 42 and 43, corresponding to the coordinate regions $x_2$ and $x_3$ on the axis X of FIG. 3, the offset is $\text{Log } P(x_3) - \text{Log } P(x_2)$. This results from the energy expressions given above in which, as mentioned above, P(x) is the value of the modulation profile in the coordinate region x according to the axis X. As the modulation profile is not in principle known, and variable according to the exposure sources, the offset of the curve sections is not previously established data and cannot in principle be corrected. The offset can, however, be calculated. This calculation consists, for example, in canceling, or at least minimizing, an intercorrelation function between the density values of the two value sets corresponding to the two curve sections. The calculation of the intercorrelation function is repeated by successively performing small offsets in the energy values associated with the density values. The offsets are continued until the intercorrelation function is cancelled or minimized. The amplitude of the successive offsets corresponds, for example, to an energy difference of two successive interpolated values 41*i* between the captured values per measurement. The calculations, repeated for each curve section, are preferably performed in a matrix, in which the density values, expressed according to the exposure energy values, form the matrix rows or columns. The offset enabling the intercorrelation function to be minimized is then applied to all the energy values of a relevant section.

In FIG. 5, the offsets are symbolized by horizontal arrows D that point, in the illustrated example, to the curve section 42 taken as reference. An extension of the curve section 42 as a broken line shows that it is part of the sought sensitometry curve in "S" form.

To prevent the extension of curve sections beyond the points whose density values are known, the sections preferably have sufficient overlap to facilitate determination of the offsets. This is obtained, as shown above, by providing sufficient amplitude of the modulation P(x) of the exposure energy.

Figure 6:
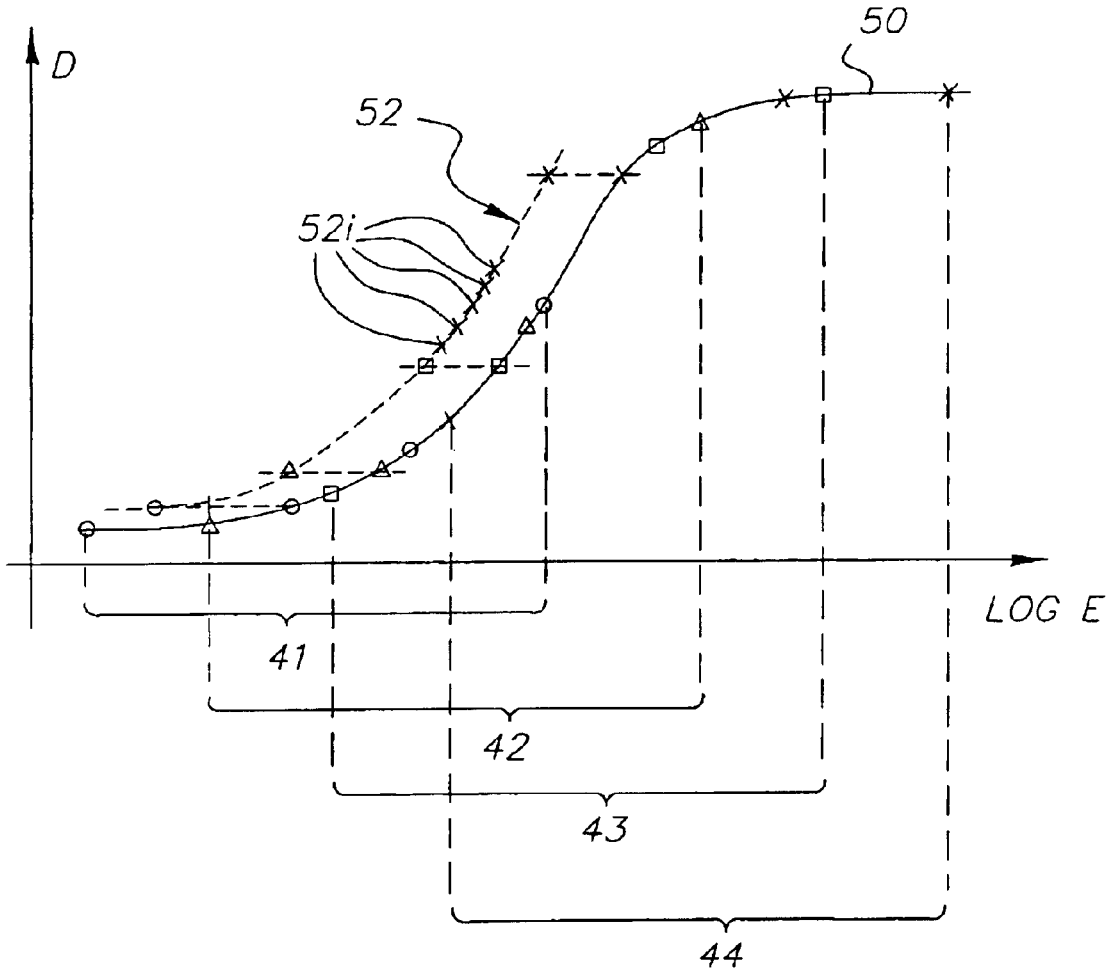
FIG. 6 represents a sensitometry curve obtained after offsetting the curve sections of FIG. 5.

FIG. 6 shows a sensitometry curve 50 obtained after finishing the energy offset of the curve sections of FIG. 5. This curve is preferably constructed by selecting only the captured density values. The values obtained by interpolation, which were used for the offset calculation, can indeed be eliminated. The range of energies scanned by the curve finally obtained is much larger than that of the exposure energies. In FIG. 6, the ranges of the exposure ranges are shown with the references 41, 42, 34, 44 of the corresponding curve sections. It is thus possible to establish the sensitometry curve despite a reduced number of ranges of the sensitometry control. This feature enables the area of the control to be limited.

The exposure energies of the ranges of the sensitometry control are not necessarily known, or at least are not known accurately. This is due, especially to the use of very simple uncalibrated sources. Errors result from this as to the exposure energy associated with the density values captured in a given range.

Such an error is shown in FIG. 5. We consider, as an example, that the density values measured in one of the control ranges, and in this case in range 22, are assigned to a wrong energy $E'_2$, instead of energy $E_2$ actually supplied to expose this range. Such an error means an offset of the density values when these are related to energy $E_2$. The offset is shown in FIG. 6 and is conveyed by an additional section 52 of the sensitometry curve shown with a broken line. The error on knowing the actual energy $E_2$ can be compensated for by offsetting the section 52 until it has an overlap with the curve 50. This operation can be performed geometrically, or preferably by a matrix calculation. The calculation is performed for example, according to an operating method comparable to that described above for the energy offset of the curve sections 41, 42, 43, 44. Here, the offset however affects the energy values taken in a given range of the sensitometry control, and not the values of the various ranges corresponding to the same value of the energy modulation profile. The calculation can in particular involve the resampling of the curve section 52 by creating interpolation values 52*i* between the captured values, according to a regular pitch, and then a matrix intercorrelation calculation performed through successive offsets between the interpolated values, each time by the value of one pitch, to minimize an intercorrelation function. More simply, this amounts to minimizing a difference Log $E'_2$–Log $E_2$. So as not to overload FIG. 6, only a few interpolation values 52*i* are shown.

The matrix calculations used to offset the curve sections 41, 42, 43, 44 of FIG. 5 and those used to correct, as FIG. 6 shows, the errors in the exposure energies can be performed iteratively and alternately by reducing the respective offsets nearer and nearer. The absolute position of the sensitometry curve 50 of FIG. 6 on the horizontal axis of the energies remains undetermined. It depends essentially on the curve section of FIG. 5 taken as reference. The indeterminacy of the global energy position is not however prejudicial to the calibration of most devices that have to process the film later.

If an exact energy positioning of the sensitometry curve were required it is possible to perform at least one known energy exposure, for example, in one of the ranges 21*a*, 22*a*, 23*a*, 24*a* of a sensitometry control conform to part (c) of FIG. 2.

The invention has been described in detail with particular reference to certain preferred embodiments thereof, but it will be understood that variations and modifications can be effected within the spirit and scope of the invention.

PARTS LIST

10 film
12 sensitometry control
14 light source
15 light source
16, a, b filter
21, a, b range of support
22, a, b range of support
23, a, b range of support
24, a, b range of support
31*a, b* curve
32*a, b* curve
33*a, b* curve
34*a, b* curve
41, i curve sections
42 curve sections
43 curve sections
44 curve sections
50 curve
52 section
52*i* interpolation value

What is claimed is:

1. A method to establish a sensitometry curve for a photographic medium, the method comprising:

a) forming on the medium at least one sensitometry control by exposing many ranges of the medium with various exposure energies, the exposure energy of each range being modulated according to a spatial modulation profile (P(x)) identical for all the ranges;

b) capturing optical density values of the sensitometry control in each range and in regions corresponding to various values of the modulation profile;

c) forming sensitometry curve sections, each section being formed from density values captured in various ranges of the sensitometry controls, but in regions corresponding to the same value of the modulation profile of the exposure energies; and d) calculating and applying energy offsets to the curve sections to obtain partial section overlapping corresponding to neighboring exposure energies.

2. A method according to claim 1, wherein the modulation profile is selected with an amplitude more than a minimum exposure energy difference between the exposure energies of the ranges of the sensitometry control.

3. A method according to claim 2, wherein the modulation profile is selected with an amplitude more than double the minimum exposure energy difference between the exposure energies of the ranges of the sensitometry control.

4. A method according to claim 1, wherein the ranges of the sensitometry control are exposed with energies according to a regular progression.

5. A method according to claim 1, wherein the step d) comprises:

associating each density value with an exposure energy value estimated according to the range of the sensitometry control in which the density value is captured, and forming sets of density values, each set containing respectively, optical density values captured in various ranges of the sensitometry control but in regions corresponding to the same value (P(x)) of the modulation profile.

6. A method according to claim 5, wherein step d) comprises the uniform offset of all the estimated energy values respectively associated with the optical density values of the same set of density values.

7. A method according to claim 5 further comprising:

forming density matrices whose columns, respectively rows, correspond with increasing density values, respectively decreasing, of the same set of values;

intercorrelating the columns, respectively rows, in relation to at least one column, respectively row, taken as reference;

searching for an energy offset, for each column, respectively row, corresponding to a minimum of an intercorrelation function of the columns, respectively rows; and applying the energy offset to the estimated exposure energy values of the set of values of the matrix column, respectively row.

8. A method according to claim 7, wherein matrix formation is preceded by the creation of additional couples of density and energy values, calculated by interpolation from the density values captured and the estimated exposure energy values.

9. A method according to claim 7 further comprising the formation of a sensitometry curve from the captured density values, associated with the offset energy values.

10. A method according to claim 1, further comprising, after step d) correcting the estimated exposure energy values.

11. A method according to claim 10, further comprising:

associating with each density value, an exposure energy value estimated according to the range of the sensitometry control in which the density value is captured and according to an estimated value of the modulation profile (P(x)) in the region of the range in which the density value is captured, and associating a uniform offset of the energy values with at least one set of density values captured in the same range of the sensitometry control, so as to tend to a single sensitometry curve.

12. A method according to claim 11, further comprising searching for minimums of intercorrelation functions of rows or columns of a matrix corresponding to sets of estimated exposure energy values, associated with densities captured in the same range of the sensitometry controls.

13. A method according to claim 5, wherein each density value is associated with a single exposure energy value.

14. A method according to claim 5, wherein each density value is associated with a combination of exposure energy values corresponding to exposures of different colors.

15. A method according to claim 14, wherein the colors are red, green and blue.

16. A method according to claim 1, wherein ranges are successively exposed with exposure energies with preset progression.

17. A method according to claim 1, wherein at least one portion of at least one range of the sensitometry control is exposed to a known reference energy.

18. A method according to claim 1, wherein the sensitometry control is formed by a succession of exposures with various exposure energies, the exposures taking place respectively on a photographic medium fixed in relation to an exposure source.

19. A method according to claim 1, wherein the sensitometry control is formed by varying the exposure energy supplied by a source and moving the photographic medium in front of the exposure source.

20. A method according to claim 1, wherein the sensitometry control is formed by exposing the photographic medium to an exposure source comprising at least one light emitting diode having a non-uniform spatial distribution of light energy.

21. A method according to claim 1, wherein the sensitometry control is formed by exposing the photographic medium to a uniform exposure source associated with a gradual attenuator.

* * * * *